United States Patent [19]

Singer

[11] 4,421,356

[45] Dec. 20, 1983

[54] SUPPORT STRUCTURE FOR A PIECE OF FURNITURE

[76] Inventor: Mark Singer, 1663 Cambridge St., Cambridge, Mass. 02138

[21] Appl. No.: 332,371

[22] Filed: Dec. 21, 1981

Related U.S. Application Data

[63] Continuation-in-part of Ser. No. 236,756, Feb. 23, 1981, abandoned.

[51] Int. Cl.[3] ..... A47C 4/02

[52] U.S. Cl. ..... 297/16; 248/165; 297/441

[58] Field of Search ..... 297/441, 440, 445, 449, 297/457, 16, 25, 45; 248/163.1, 164, 165, 432

[56] References Cited

U.S. PATENT DOCUMENTS

| | | | |
|---|---|---|---|
| 244,216 | 7/1881 | Fenby . | |
| 1,142,006 | 6/1915 | Barber | 297/449 |
| 2,689,602 | 9/1954 | Morgan . | |
| 3,901,551 | 8/1975 | Wiesner . | |
| 3,972,559 | 8/1976 | Anacker | 297/441 X |
| 4,014,591 | 3/1977 | Gittings | 297/441 X |
| 4,148,520 | 4/1979 | Miller . | |
| 4,251,106 | 2/1981 | Gilbert | 297/441 X |

FOREIGN PATENT DOCUMENTS

| | | | |
|---|---|---|---|
| 389653 | 3/1922 | Fed. Rep. of Germany | 297/449 |
| 11379 | of 1913 | United Kingdom | 297/16 |

OTHER PUBLICATIONS

Fuller, R. B., Synergetics, p. 372, Collier MacMillan (1975).

*Primary Examiner*—William E. Lyddane

[57] ABSTRACT

Substantially rigid support structure for a piece of furniture, having a pair of transversely spaced columnar struts, the axes of the struts being inclined with respect to the horizontal, an integral generally X-shaped rigid member, also inclined with respect to the horizontal and positioned intermediate the struts, and a plurality of tension members interconnecting the struts and the X-shaped member to form a substantially rigid structure.

10 Claims, 4 Drawing Figures

SUPPORT STRUCTURE FOR A PIECE OF FURNITURE

This application is a continuation-in-part of Singer Ser. No. 236,756, filed Feb. 23, 1981, now abandoned.

FIELD OF THE INVENTION

This invention relates to support structures for chairs and the like.

BACKGROUND OF THE INVENTION

Lightweight support structures have, in the past, been used to provide a frame for "sling"-type chairs, i.e., chairs in which the seating surface consists of a piece of flexible fabric support either at its four corners or along two nonadjacent sides. The fabric is usually sized such that, when attached to the frame, it is not taut, but drapes somewhat and thus provides both posterior and back support.

Often the support structure has been made up of a number of support members which are pivotably attached to one another, such that the chair may be collapsed for transportation, etc. Fenby, U.S. Pat. No. 244,216 and Morgan, U.S. Pat. No. 2,689,602 disclose such support structures.

More recently, support structures, constructed solely of pure tension members and pure compression members have been devised. The pure compression members are commonly struts (e.g., poles), the ends of which are interconnected by the pure tension members, usually cables or ropes. Support structures of this type, examples of which are to be found in Miller, U.S. Pat. No. 4,148,520 and Wiesner, U.S. Pat. No. 3,901,551, have been termed "tensegrity" (or "tensional-integrity") types of structures.

The term "tensegrity" was apparently coined by Buckminster Fuller, to describe structures which, as described in Fuller, R. B., *Synergetics,* Collier MacMillian (1975), have the ability "to yield increasingly without ultimately breaking or coming asunder". Such structures inherently lack rigidity. A more comprehensive treatment of tensegrity is to be found in the above referenced work.

SUMMARY OF THE INVENTION

I have discovered that struts of a certain shape may be held in spaced juxtaposition to one another through the use of cables, to form a chair support structure which is rigid and yet inexpensive of manufacture.

In general, the invention features a pair of transversely spaced columnar struts, the axes of the struts being inclined with respect to the horizontal, an integral generally X-shaped rigid member, also inclined with respect to the horizontal and positioned intermediate the struts, and a plurality of tension members interconnecting the struts and the X-shaped member to form a substantially rigid structure.

In preferred embodiments, the struts and the X-shaped member are all maintained in a spaced relationship relative to one another and means are included for providing initial tension in the plurality of tension members; seating means are included which are supported by the uppermost ends of the columnar struts and the pair of uppermost ends of the X-shaped member; the uppermost pair of arms of the X-shaped members have an outermost portion which is nearly vertical, the seating means contacts the X-shaped member along a substantial length of the nearly vertical portions, stiffening means are included, in contact with the seating means, to cause a portion of the seating means to form a flat seating surface, and cushion means are included which overlie the seating means and the stiffening means.

In a most preferred embodiment, the two columnar struts are connected together near their upper ends by a rigid member to prevent the upper ends from converging when a load such as a seat is suspended between the struts.

DESCRIPTION OF THE PREFERRED EMBODIMENT

We turn now to a description of the preferred embodiment, after first briefly describing the drawings.

DRAWINGS

STRUCTURE

Figure 1:
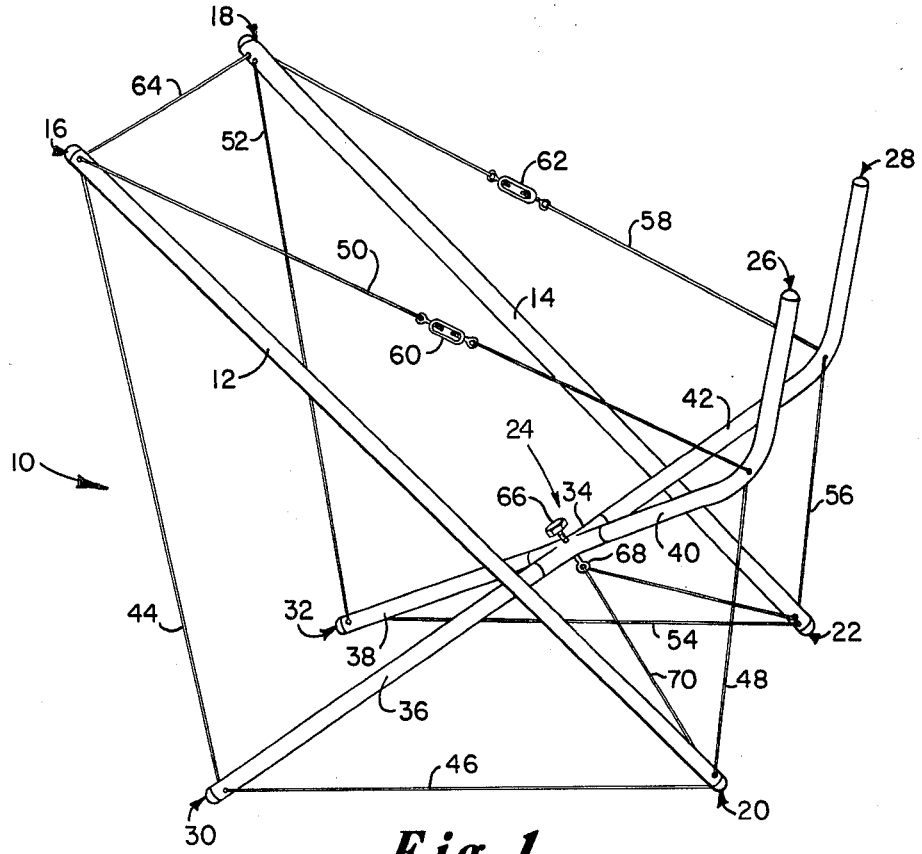
FIG. 1 is an isometric view of a support structure embodying the invention.

Referring now to FIG. 1, support structure 10 includes right and left support struts 12 and 14, respectively, two elongated tubular members which are parallel and transversely spaced from one another and positioned so as to form approximately a 45° angle with the horizontal. Struts 12 and 14 have, respectively, upper ends 16 and 18, which define the top rear of structure 10, and lower ends 20 and 22, which contact the floor, etc. and thereby act as front leg portions.

Disposed intermediate of struts 10 and 12 and inclined approximately 30° from the horizontal is a rigid X-shaped member 24, having two uppermost ends 26 and 28, which (as described more fully below) serve as the frontmost supports for a fabric sling, and two lowermost ends 30 and 32, which contact the floor, thereby acting as rear leg portions.

While X-member 24 acts in an integral and unitary fashion, in its present embodiment, it is, for purposes of transportability, constructed from a number of submembers: a central hub 34, two straight tubular struts 36 and 38, and two additional struts 40 and 42, of generally doglegged shape. Hub 34 is provided with four threaded holes (not shown) into which screw projecting threaded studs (also not shown) on struts 36 38, 40 and 42. The depth of threading is such that, when all the submembers are fully engaged, X-member 24 is thereby formed. This particular type of modular construction is not essential to the functioning of support structure 10; X-member 24 could be cast as one integral piece or its submembers could be permanently joined, as by welding. It is critical, however, that, when assembed, X-member 24 function as a singular integral unit.

Four separate cables are attached to each side of structure 10 (i.e., both the right and left sides), so as to generally define a tensional quadrilateral. On the right side of structure 10, cables 44, 46, 48 and 50 define this quadrilateral. The respective corresponding cables on the left side of structure 10 are cables 52, 54, 56 and 58. The above referenced cables act as tension members and attach at or near the eight ends of struts 12 and 14 and X-member 24, the point of attachment to the uppermost portions of X-member 24 being at the dogleg bends rather than at ends 26 and 28.

Turnbuckles 60 and 62 are spliced into cables 50 and 58, respectively, at positions approximately intermediate their end points.

A horizontal cable 64 joins the two uppermost ends 16 and 18 of struts 12 and 14.

Through hub 34 and transverse to X-member 24 is provided a threaded throughgoing hole, through which extends a correspondingly threaded adjustment bolt 66, having an attached eyelet 68. A final cable 70 joins lowermost ends 20 and 22 of struts 12 and 14, passing intermediately through eyelet 68.

Figure 2:
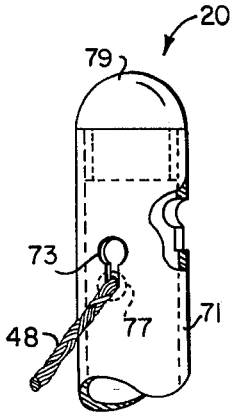
FIG. 2 is a detailed view, partly broken away and in section, of an end of one of the struts of the support structure of FIG. 1, showing the details of cable attachment.

We turn now to FIG. 2, which illustrates the manner in which the above referenced cables are anchored to struts 12 and 14 and X-member 24. Illustratively, end 20 of strut 12 consists of a tubular wall construction 71 (e.g. aluminium tubing), into which has been formed a keyhole-shaped aperture 73. Cable 48 (as well as all other cables) is provided with a "ball shank terminal" 77 which may be inserted into aperture 74 and locked therein by tension. A plastic plug 79 terminates tube 72.

OPERATION

Assembly of structure 10 is straightforward; turnbuckles 60 and 62 are initially adjusted to provide some slack and all cables are secured to their appropriate points of attachment (as shown on FIG. 1), by inserting their ball shank ends into the corresponding keyhole apertures. This completed, turnbuckles 60 and 62 are then tightened to increase the tension in cables 50 and 58. This increases the tension of all the remaining cables and structure 10 becomes increasingly and substantially rigid throughout. Noticeably, the two tensional quadrilaterals tend to force uppermost ends 16 and 18 of struts 12 and 14 apart from one another, thereby increasing the tension in cable 64, a desirable result since insufficient tension in this cable can cause ends 16 and 18 to converge when weight is placed on the structure, causing a general feeling of lack of rigidity. Adjustment bolt 66 may be employed to urge lowermost ends 20 and 22 of struts 12 and 14 closer to one another, with the result that the tension in cable 64 is further increased.

Figure 3:
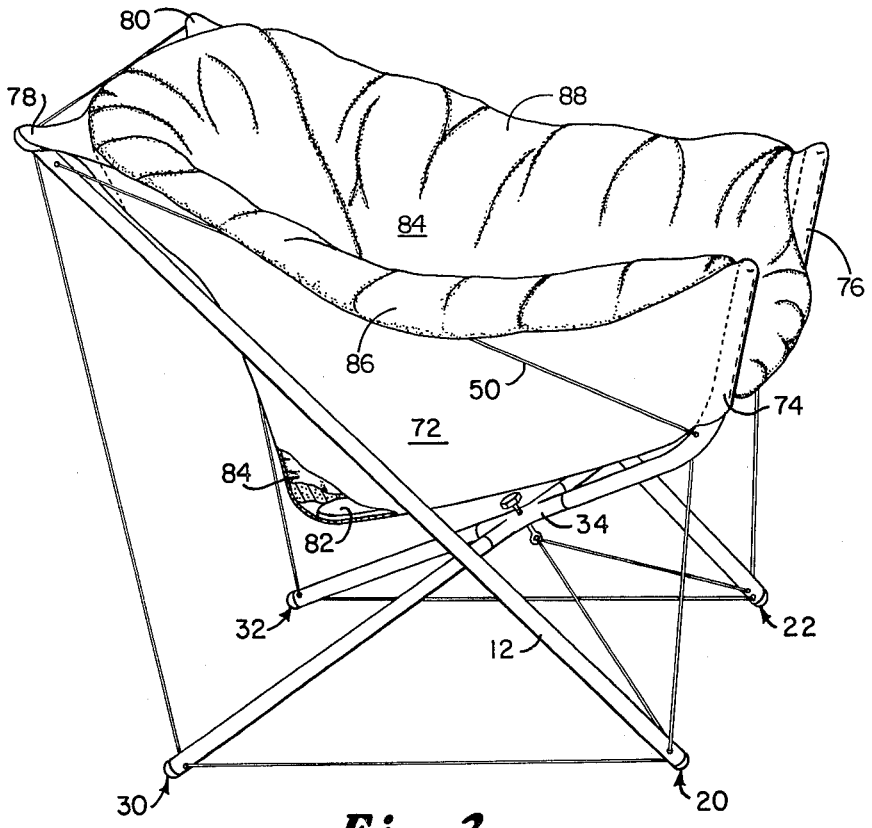
FIG. 3 is an isometric view of the support structure of FIG. 1 supporting a seating system.

Referring now to FIG. 3, in operation, structure 10 is first fitted with a contoured sling 72, having two sewn forward pockets 74 and 76 and two sewn rearward pockets 78 and 80, which, respectively, fit over and are supported by uppermost ends 26, 28, 16 and 18 of struts 12 and 14 and X-member 24. Forward pockets 74 and 76 are of generally cylindrical construction (closed at the top end) and contact a substantial portion of the nearly vertical doglegged portions of X-member 24, thereby providing the sides of sling 72 (which provide armrest support) with some lateral and vertical rigidity.

Sling 72 is preferably contoured in the sense that it is not merely a simple generally rectangular sheet of fabric, but is constructed of at least two pieces of fabric (a bottom piece and a side piece), sewn together to form a shape resembling a so-called "bucket" seat. A stiffener 82, of generally rectangular shape (constructed of, for example, masonite) is placed adjacent the bottom portion of sling 72 to form a more rigid seating surface.

Lastly, a contoured and upholstered cushion 84 is placed over sling 72 and stiffener 82, and the construction is complete. Preferably, cushion 84 has extended armrest portions 86 and 88 which drape over the upper side edges of sling 72.

Other embodiments are within the following claims. For example, as mentioned above X-member 24 need not be constructed from several constituent submembers but could, instead, be fabricated integrally by any well known method (e.g., welding, casting, etc.); cable 70 (which restrains ends 20 and 22 from moving asunder) and its attendant adjustment bolt 66 may be replaced with a pair of crossing cables, one extending between ends 20 and 32 and the other between ends 30 and 22; cable 70 need not be connected to the mid-point of X-member 24 but may be connected to both arms 40, 42 at a location between their crossing and their ends, or may be connected to both of arms 36, 38 at a location between their crossing and their ends; cable 70 can also be connected to a rigid crossbar connecting either arms 36, 38 or arms 40, 42 at a location between their crossing and their ends; cable 64 and cable 70 can also be interchanged, so that one tension member directly connects ends 20 and 22, while another connects ends 16 and 18 to X-member 24; moreover, sling 72 can be replaced by any other desired support member, rigid or flexible, such as a table top.

Figure 4:
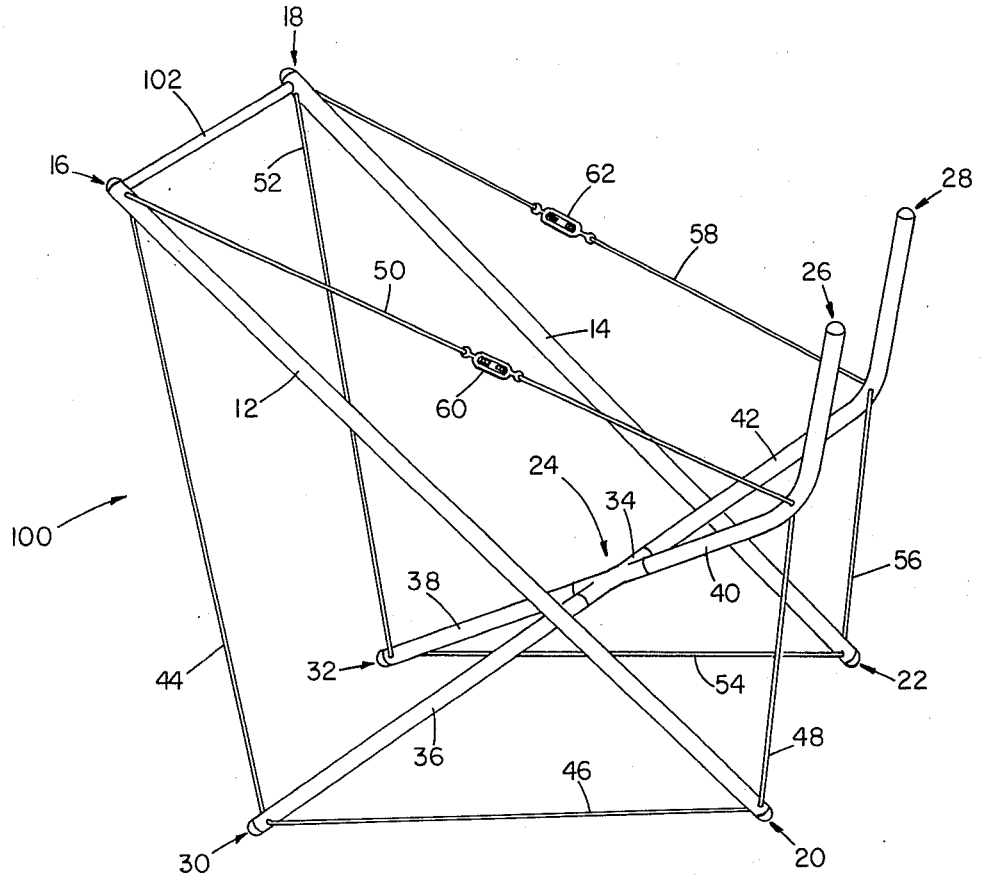
FIG. 4 is an isometric view of a preferred support structure of the invention.

Finally, a more preferred embodiment, structure 100, is shown in FIG. 4. Structure 100 is the same as structure 10, except that horizontal cable 64, joining the upper ends of columnar struts 12, 14, and cable 70, joining the lower ends, are replaced by a single rigid member 102 connecting the upper ends 16, 18 of struts 12, 14. This holds ends 16, 18 together, as tension cable 64 does in structure 10, and prevents ends 16, 18 from converging when the back of a seat is suspended from it, eliminating any sagging which may occur because of the flexibility of cable 64 and at the same time serving to hold the upper ends of struts 12, 14 in spaced apart position and thus eliminating the need for cable 70. Contoured sling 72, stiffener 82, and cushion 84 can be attached to structure 100 in the manner that they are shown attached to structure 10 in FIG. 3 to provide a chair, but flexible sling 72 may also be suspended from rigid member 102 instead of or in addition to being supported from the upper ends 16, 18 of struts 12 and 14.

What is claimed is:

1. A substantially rigid support structure, comprising a pair of transversely spaced generally parallel rigid columnar struts, the axes of said struts being inclined with respect to the horizontal, an integral generally X-shaped rigid member, oppositely inclined with respect to the horizontal and positioned intermediate and spaced from said struts, a flexible tension member connecting each lower end of each strut with one lower end of the X-shaped rigid member at the side adjacent said strut, a flexible tension member connecting each lower end of each strut with one upper end of the X-shaped rigid member at the side adjacent said strut, a flexible tension member connecting each upper end of each strut with one lower end of the X-shaped rigid member at the side adjacent said strut, a flexible tension member connecting each upper end of each strut with one upper end of the X-shaped rigid member at the side adjacent said strut, and means for maintaining the upper end of said struts spaced apart from each other.

2. The support structure of claim 1 wherein said struts have an uppermost pair of ends and said X-shaped member has a pair of uppermost extending arms and further comprising seating means supported by said uppermost pair of ends and said uppermost pair of arms.

3. A support structure as claimed in claim 2 in which said spacing means comprises a flexible tension member connecting each lower end of each strut with said X-shaped rigid member at a position spaced from the ends of its arms.

4. A support structure as claimed in claim 2 in which said spacing means comprises a rigid member connecting the upper portions of said columnar struts.

5. The support structure of claim 2 wherein said uppermost pair of arms are bent upwardly such that the outermost portions of said pair of arms are nearly vertical and said seating means contacts said X-shaped member along a substantial length of said nearly vertical portions, and further comprising stiffening means, in contact with said seating means, for causing a portion of said seating means to form a flat seating surface.

6. The support structure of claim 5 further comprising cushion means overlying said seating means and said stiffening means.

7. A support structure as claimed in claim 5 in which said spacing means comprises a rigid member connecting the upper portions of said columnar struts.

8. A support structure as claimed in claim 1 in which said spacing means comprises a flexible tension member connecting each lower end of each strut with said X-shaped rigid member at a position spaced from the ends of its arms.

9. A support structure as claimed in claim 8 including means for adjusting the tension in the last said tension members.

10. A support structure as claimed in claim 1 in which said spacing means comprises a rigid member connecting the upper portions of said columnar struts.

* * * * *